US006250277B1

(12) United States Patent
Adamovski et al.

(10) Patent No.: US 6,250,277 B1
(45) Date of Patent: Jun. 26, 2001

(54) TOROIDAL INTERNAL COMBUSTION ENGINE

(75) Inventors: Victor Isaevich Adamovski, Petah Tikva (IL); Anatoly Georgievich Bakanov, Voronezh (RU)

(73) Assignee: Medis El Ltd., Yehud (IL)

( * ) Notice: Subject to any disclaimer, the term of this patent is extended or adjusted under 35 U.S.C. 154(b) by 0 days.

(21) Appl. No.: 09/146,362

(22) Filed: Sep. 3, 1998

Related U.S. Application Data

(63) Continuation of application No. 09/069,545, filed on Apr. 30, 1998, now abandoned, which is a continuation of application No. 08/946,986, filed on Oct. 8, 1997, now abandoned, which is a division of application No. 08/743,434, filed on Nov. 1, 1996, now Pat. No. 5,797,366.

(51) Int. Cl.[7] ..... F02B 53/00
(52) U.S. Cl. ..... 123/238; 123/229; 123/232
(58) Field of Search ..... 123/205, 237, 123/238, 229, 232

(56) References Cited

U.S. PATENT DOCUMENTS

| | | | | |
|---|---|---|---|---|
| 1,311,858 | * | 7/1919 | Fischer | 123/238 |
| 1,688,816 | * | 10/1928 | Kraus | 123/238 |
| 2,062,753 | * | 12/1936 | Linn | 123/238 |
| 2,273,625 | * | 2/1942 | Concannon | 123/238 |
| 3,699,930 | * | 10/1972 | Bunce | 123/238 |
| 3,921,595 | | 11/1975 | Saunders | 123/237 |
| 3,935,840 | * | 2/1976 | Fisher | 123/238 |
| 4,203,410 | * | 5/1980 | Ramer | 123/205 |

FOREIGN PATENT DOCUMENTS

| | | | | |
|---|---|---|---|---|
| 478430 | * | 4/1975 | (AU) | 123/238 |
| 2159066 | * | 6/1973 | (DE) | 123/238 |
| 52-40682 | | 10/1977 | (JP) . | |
| WO 93/21423 | | 4/1993 | (WO) . | |

* cited by examiner

*Primary Examiner*—Michael Koczo
(74) *Attorney, Agent, or Firm*—Mark M. Friedman

(57) ABSTRACT

A rotary engine with one or more toroidal chambers defined by rotors that rotate within cylindrical housings. Pistons project into the chambers from the rotors. The pistons cooperate with valves to define compression regions and expansion regions in the chambers. The rotors, the pistons, the valves, or a combination thereof define or include combustion regions of constant volume wherein a fuel-air mixture compressed in the compression regions burns and then is ejected to the expansion regions. Fuel is injected into both the compression regions and the expansion regions, so that the engine operates according to the Trinkler cycle. In a first embodiment of the engine, the valves are rotary and include recesses that accommodate the pistons as the pistons pass the valves. As a piston transits from a compression region to an expansion region via a valve, the space in the valve recess not occupied by the piston is the combustion region. In a second embodiment of the engine, the motion of two pistons in two chambers is coordinated so that as one piston arrives at the end of a compression region of its chamber and the other piston enters an expansion region of its chamber, the volume between the two pistons is the combustion region. In a third embodiment of the engine, the combustion region is enclosed by two tandem rotary valves of two different chambers. In a fourth embodiment, the combustion regions are in rotary combustion chambers inside the pistons or inside the rotors.

8 Claims, 16 Drawing Sheets

TOROIDAL INTERNAL COMBUSTION ENGINE

This is a continuation in part of U.S. patent application Ser. No. 09/069,545, filed Apr. 30, 1998, abandoned, which is a continuation in part of U.S. patent application Ser. No. 08/946,986, filed Oct. 8, 1997, abandoned, which is a divisional application of U.S. patent application Ser. No. 08/743,434, filed Nov. 1, 1996, now U.S. Pat. No. 5,797,366, issued Aug. 25, 1998.

FIELD AND BACKGROUND OF THE INVENTION

The present invention relates to internal combustion engines and, more particularly, to an internal combustion engine that is significantly more efficient than those known heretofore.

Internal combustion piston engines have been familiar and ubiquitous since the days of Otto and Diesel. These engines suffer from several widely recognized deficiencies. One is that their thermal efficiencies are far less than their theoretical efficiencies according to the second law of thermodynamics. Up to 30% of the heat released by fuel combustion is absorbed by the engine cooling systems. Another 30% is devoted to engine operation, including compressing air or an air-fuel mixture in the cylinders of these engines. From 5% to 20% of the available energy may be wasted because of incomplete combustion of hydrocarbon fuels. The net result is that these engines generally have overall efficiencies between 32% and 42%.

Another deficiency of these engines is that their exhausts tend to contain toxic substances: carbon particles and carcinogenic hydrocarbons because of incomplete combustion, and nitrogen oxides formed at the high (1800° C. to 2000° C.) combustion temperatures that characterize these engines. A third is that they provide power by transforming the reciprocating motion of their pistons to the rotary motion of their crankshafts. When the fuel-air mixture in a cylinder of an internal combustion engine explodes, the piston is at or near top dead center. At this position, the moment arm, across which the rod connecting the piston to the crankshaft transfers force to the crankshaft, is close to zero. Therefore, the piston exerts minimal torque on the crankshaft. As the piston moves down from top dead center, the moment arm through which the piston transfers force increases, but in the meantime the combustion gases expand somewhat, losing some of their propulsive force, so that the maximum torque exerted on the crankshaft is less than the maximum torque that could be exerted if the force of the piston could always be transferred to the crankshaft at maximum moment arm. Several attempts have been made to address some of these deficiencies. Ferrenberg et al. (U.S. Pat. No. 4,928,658) use a heat exchanger to preheat the input fuel and air of an internal combustion engine with some of the heat of the exhaust gases. Loth et al. (U.S. Pat. No. 5,239,959) ignite the fuel-air mixture in a separate combustion chamber before introducing the burning mixture to the cylinder, in order to attain more complete combustion and inhibit the formation of nitrogen oxides. Forster (U.S. Pat. No. 5,002,481) burns a mixture of fuel, air and steam. This mixture burns at a relatively low temperature of about 1400° C., and nitrogen oxides are not formed. Gunnerman (U.S. Pat. No. 5,156,114) burns a mixture of hydrocarbon fuel and water, but requires a hydrogen-forming catalyst to achieve the same power with his mixture as with ordinary gasoline. Each of these prior art patents addresses only one of the defects of reciprocating internal combustion engines. None addresses the problem in its totality.

U.S. Pat. No. 5,797,366 describes an engine that further addresses the outstanding deficiencies of existing internal combustion engines. In this engine, a mixture of fuel, air and steam is burned in one or more combustion chambers, each combustion chamber being defined by a toroidal combustion chamber housing, a piston and a valve. The mixture is burned at a temperature between about 1400° C. and about 1800° C., thereby minimizing the formation of nitrogen oxides and other pollutants while reducing the heat lost to conduction and radiation through the engine walls. The axis of rotation of the power shaft of the engine is perpendicular to the plane of the combustion chamber housing. The piston is connected to the power shaft of the engine, and the force of the piston always is applied to the power shaft at a constant moment arm perpendicular to that axis of rotation, so that maximum torque is imposed on the power shaft.

In the toroidal engine of U.S. Pat. No. 5,797,366, the volume of the combustion chamber increases as the burning mixture pushes the piston away from the valve. This increase in volume, before the mixture is entirely burned, tends to decrease the thermodynamic efficiency of this engine.

There is thus a widely recognized need for, and it would be highly advantageous to have, an internal combustion engine that further approaches its theoretical thermal efficiency while emitting minimal pollution.

SUMMARY OF THE INVENTION

According to the present invention there is provided an engine, including: (a) at least one housing; (b) for each of the at least one housing: a rotor, rotatably mounted within the each housing, the rotor and the each housing defining between them a toroidal chamber, the rotor including at least one piston projecting into the toroidal chamber; and (c) for each the at least one housing, at least one valve, movably mounted within the at least one housing, at least one element selected from the group consisting of the rotor, the at least one piston and the at least one valve defining at least one combustion region at least while the at least one piston moves past the at least one valve.

According to the present invention there is provided an engine, including: (a) a housing; (b) a rotor, mounted within the housing to rotate about an axis of rotation and having an outer surface including at least one portion of variable distance from the axis of rotation; and (c) a valve, rotatably mounted within the housing and shaped to maintain rolling contact with the outer surface as the rotor and the valve rotate within the housing.

Like the prior art engine of U.S. Pat. No. 5,797,366, the engine of the present invention includes one or more housings with toroidal interiors. Within each housing rotates a rotor to which is attached one or more pistons that projects into the toroidal interior of the housing, so that the rotor of the present invention is analogous to the ring seal of U.S. Pat. No. 5,797,366. The rotor and the housing define between them a toroidal chamber. One or more valves in the housing alternately seals the region between itself and an approaching or departing piston or moves to allow the piston to pass. The difference between the engine of the present invention and the engine of U.S. Pat. No. 5,797,366 is that in the preferred embodiment of the engine of U.S. Pat. No. 5,797,366, separate toroidal chambers are used for compression, combustion and expansion; whereas in the engine of the present invention, the valves, the pistons, the rotor, or some combination thereof define a combustion region of approximately constant volume in which combustion takes place as the valve or valves move to accommodate the transit past the one or more valves of the one or more pistons. This allows the engine of the present invention to operate according to the Trinkler cycle: A mixture of compressed air and fuel introduced into the combustion region by the cooperative motion of the pistons and the valves burns therein at approximately constant volume. The burning mixture then is released to an expansion region, where more fuel is injected to continue the burning and keep the expanding mixture at least initially at approximately constant pressure. Thus, the engine of the present invention is more efficient than the engine of U.S. Pat. No. 5,797,366, in which the combustion occurs in a steadily increasing volume.

In a first preferred embodiment of the engine of the present invention, the valve includes a circular disk with a recess shaped to accommodate the pistons as the pistons pass the valve. The constant-volume combustion region is the space between a passing piston and the interior of the recess. The disk rotates in synchrony with the rotor so that while a piston is not passing the valve, the valve seals off the interior of the housing to form a compression region as a piston approaches the valve or to form an expansion region as a piston departs from the valve.

In a second preferred embodiment of the engine, with two axially adjacent toroidal housings, with two such axially adjacent valves, one of the two axially adjacent valves in each housing, and with the two rotors joined to rotate together within the housings, a port is provided, adjacent the two valves, that connects the interiors of the two housings. The pistons of one rotor lag the pistons of the other rotor, and the rotors are provided with ports that line up with the interhousing port when the valves are between a lagging piston of one rotor and the corresponding leading piston of the other rotor. Those two pistons then define between them a constant-volume combustion region that spans the two housings as the valves move to accommodate the passage of the pistons. Prior to the arrival of the lagging piston, that piston compresses the air-fuel-steam mixture against the corresponding valve. As the leading piston departs, the hot burning combustion products push the leading piston away from the corresponding valve.

In a third preferred embodiment of the engine of the present invention, also with two axially adjacent toroidal housings, also with two such adjacent valves, one valve per housing, and also with the two rotors joined to rotate together within the housings, the adjacent circular disks of the valves include opposed chambers that define a constant-volume combustion region. The pistons of one rotor lead the pistons of the other rotor. The leading piston of a pair of matched pistons compresses the air-fuel-steam mixture against the corresponding valve, and then pushes the compressed mixture into the combustion region while passing the valve. The mixture is heated by combustion and then released to the other housing as the lagging piston passes the other valve. The hot burning mixture then pushes the lagging piston away from the other valve.

In a fourth preferred embodiment of the engine of the present invention, the combustion regions are enclosed within the pistons or within the rotor adjacent to the pistons. The valves are either the rotating valves of the first embodiment, or blade valves, or rotating valves whose outer surfaces are shaped to maintain rolling contact with the outer surface of the rotor. The latter valve-rotor combination is a further innovative aspect of the present invention. As a piston approaches a valve, the piston compresses the air-fuel-steam mixture against the valve. The compressed mixture is admitted to the combustion region inside or adjacent to the piston, where the mixture burns. The resulting hot burning mixture is released after the piston passes the valve, to push the piston away from the valve. Most preferably, separate compression and expansion valves are provided, to allow time for constant volume combustion as the piston transits from the compression valve to the expansion valve.

Berry, in U.S. Pat. No. 2,447,929, also teaches an internal combustion engine in which an air-fuel mixture is compressed in a toroidal compression chamber, ignited in a "pre-combustion and firing chamber" of substantially constant volume, and allowed to flow into a toroidal expansion chamber. The structural difference between Berry's engine and the engine of the present invention is that Berry's pre-combustion and firing chamber is separate from the housings of the toroidal chambers and the rotors, pistons and valves thereof, whereas the combustion region of the present invention is defined by the rotors and/or the pistons and/or the valves thereof.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a toroidal internal combustion engine in which the rotors, the pistons, and/or valves define one or more combustion regions of approximately constant volume, thereby allowing the implementation of a Trinkler cycle.

The principles and operation of a toroidal internal combustion engine according to the present invention may be better understood with reference to the drawings and the accompanying description.

Figure 1:
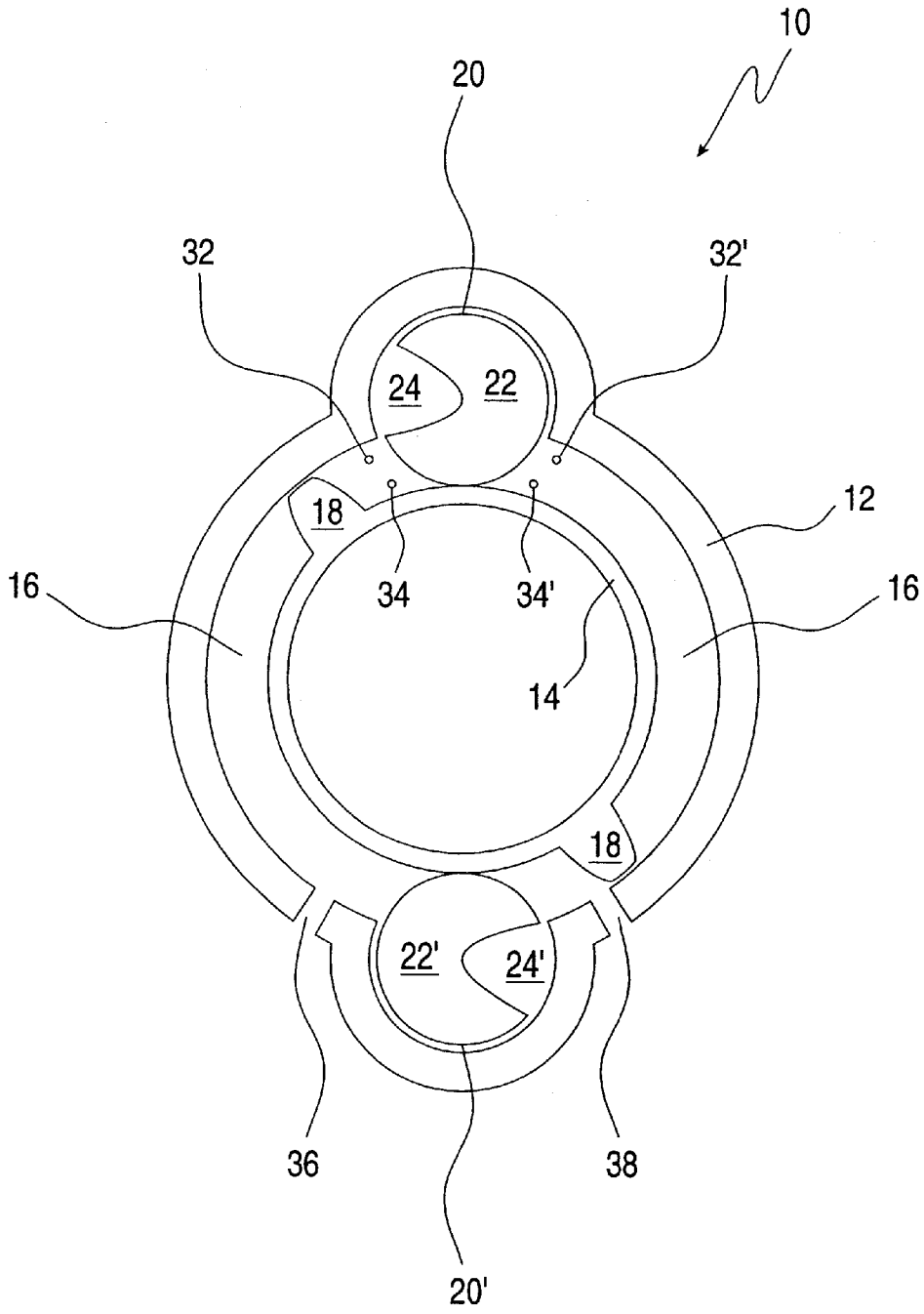
FIG. 1 is a transverse cross section of a first embodiment of an engine of the present invention.

Referring now to the drawings, FIG. 1 is a transverse cross-section of a first embodiment 10 of an engine of the present invention. Within a stationary housing 12 rotates an annular rotor 14. Rotor 14 is rigidly attached to a central drive shaft (not shown) that is coaxial with rotor 14 and with housing 12. Housing 12 and rotor 14 define between them a toroidal chamber 16. Two pistons 18 project from rotor 14 into chamber 16. On opposite sides of housing 12 are two housing recesses 20 and 20' that accommodate two disk-shaped valves 22 and 22' that rotate within housing recesses 20 and 20' in directions opposite to the direction of rotation of rotor 14. Each valve 22 and 22' includes a valve recess 24, 24'. The outer diameter of rotor 14 is twice the diameters of valves 22 and 22'. Valves 22 and 22' rotate twice for each rotation of rotor 14, so that the surfaces of valves 22 and 22' and of rotor 14 that are in mutual contact do not slide relative to each other. The rotations of rotor 14 and valves 22 and 22' are synchronized by conventional mechanical linkages (not shown). Valve recesses 24 and 24' accommodate pistons 18 as pistons 18 move past valves 22 and 22'. For this purposes, the matching surfaces of pistons 18 and valve recesses 24 and 24' are sections of the surfaces of right circular cylinders, as described by M. L. Novikov in *Tooth Gearings with New Engagement*, N. A. Zhukovsky High Military Engineering Academy, Moscow, 1958 (in Russian).

Figure 2A:
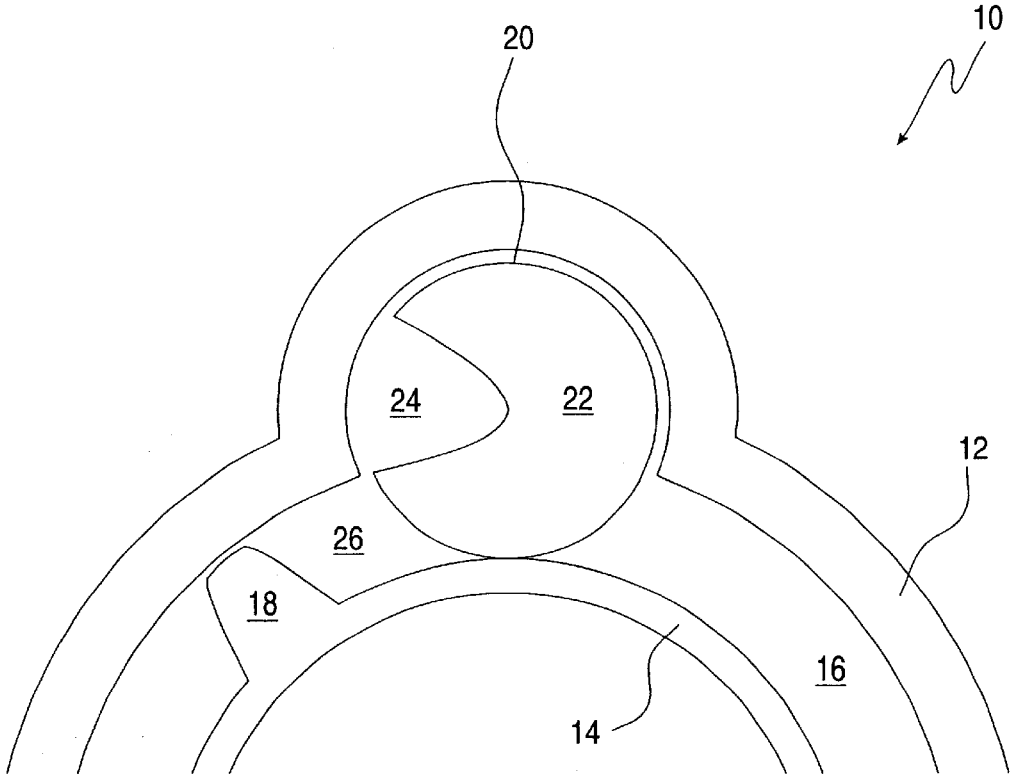
FIGS. 2A, 2B and 2C show a piston of the engine of FIG. 1 in three different positions relative to the upper valve of FIG. 1.
Figure 2B:
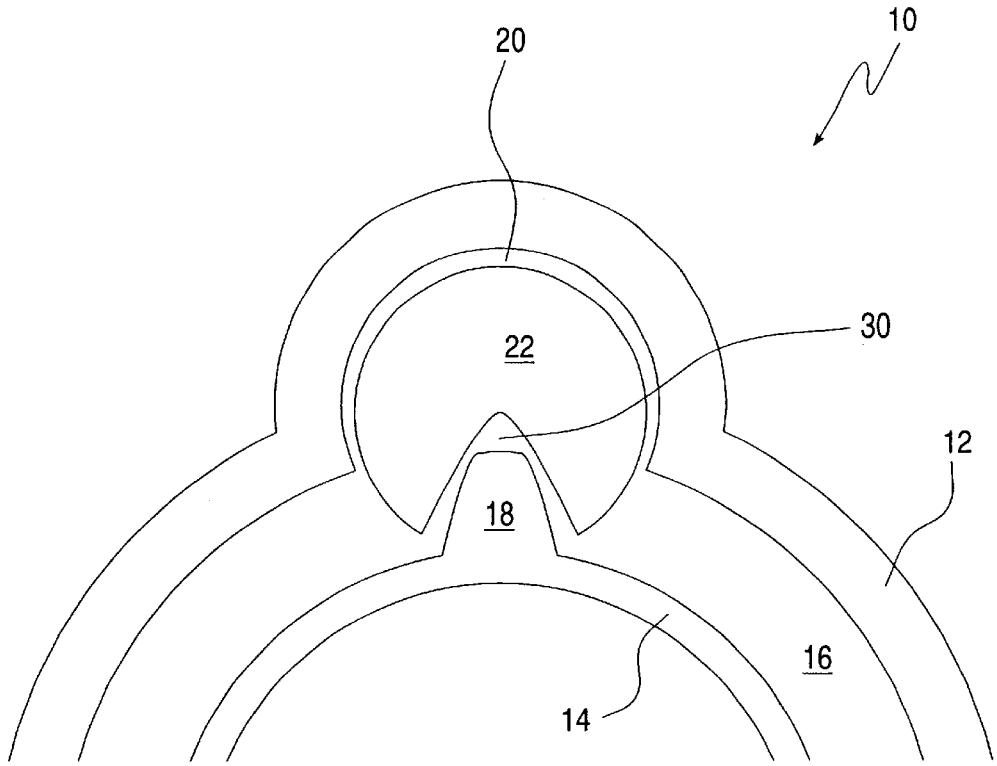
Figure 2C:
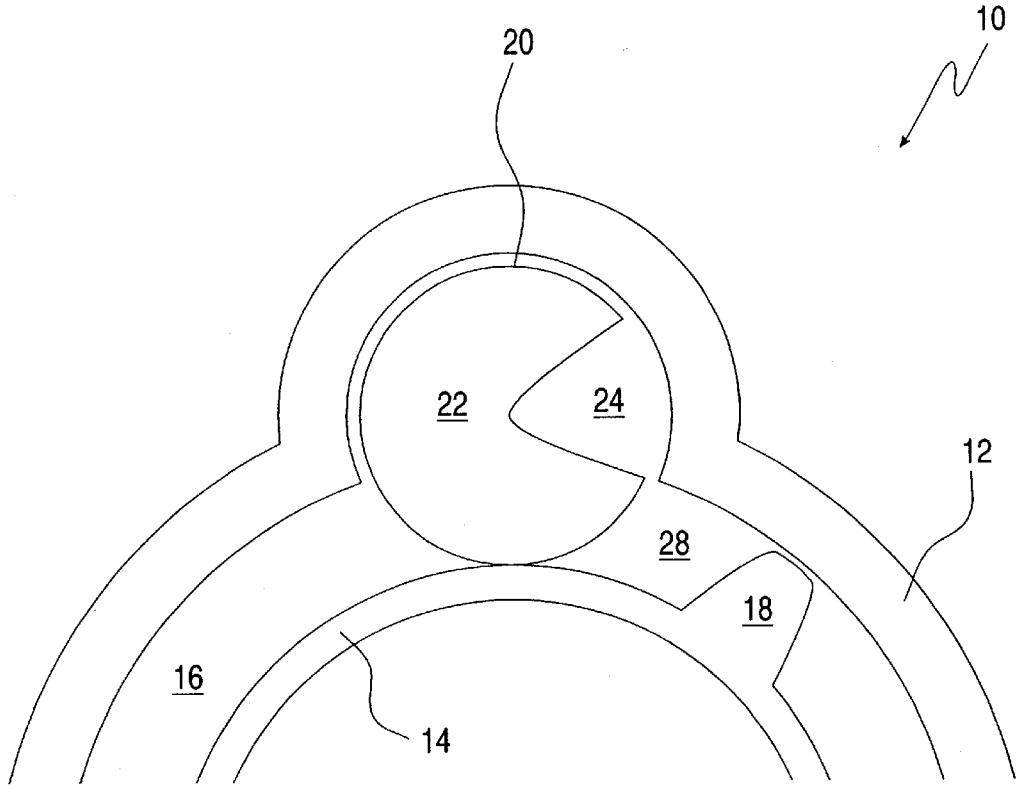

FIGS. 2A, 2B and 2C show a piston 18 in three different positions as rotor 14 rotates clockwise in housing 12 past counterclockwise-rotating valve 22. In FIG. 2A, as piston 18 approaches valve 22, piston 18 and valve 22 define a compression region 26 in chamber 16. In FIG. 2B, piston 18 is entirely within valve recess 24. The space within valve recess 24 that is not occupied by piston 18 is a combustion region 30 whose volume is approximately constant as piston 18 moves past valve 22. In FIG. 2C, as piston 18 departs from valve 22, piston 18 and valve 22 define an expansion region 28 in chamber 16.

The operation of engine 10, with rotor 14 rotating clockwise, is as follows. As a piston 18 sweeps through the left side of chamber 16, piston 18 compresses air ahead of itself, in compression region 26, while drawing in more air behind itself into chamber 16 via air inlet port 36. As piston 18 approaches valve 22, fuel is injected via a fuel injection port 32. Depending on the compression ratio in compression region 26, either the compressed fuel-air mixture ignites spontaneously when piston 18 is almost at valve 22, or an ignition source 34, such as a spark plug, ignites the compressed fuel-air mixture when piston 18 is almost at valve 22. As piston 18 passes valve 22, piston 18 and valve 22 define between them combustion region 30, where most of the combustion takes place at approximately constant volume. As piston 18 departs from valve 22, the hot, high-pressure gas created by the combustion process leaves combustion region 30 into expansion region 28 and pushes piston 18, thereby creating torque. More fuel is injected via a fuel injection port 32' to continue the combustion and maintain the expanding gas at least initially at approximately constant pressure. As piston 18 sweeps through the right side of chamber 16, piston 18 pushes residual gases from the previous cycle out through exhaust port 38.

On startup, only fuel is injected via fuel injection port 32. During steady state operation, up to 15% steam is injected along with the fuel, as described in U.S. Pat. No. 5,797,366, to allow operation at lower temperatures than would otherwise be possible.

Engine 10 is reversible, in the sense that engine 10 can be operated with rotor 14 rotating counter-clockwise and valves 22 and 22' rotating clockwise. For this purpose, the roles of fuel injection ports 32 and 32' are interchanged, and an alternate ignition source 34' is provided to the right of valve 22. During clockwise operation, air inlet port 36 functions as an exhaust port and exhaust port 38 functions as an air inlet port.

The above description in terms of housing 12 remaining stationary while rotor 14 rotates therewithin is illustrative rather than limitative. Rotor 14 can remain stationary while housing 12 rotates thereabout, in which case housing 12, rather than rotor 14, is rigidly attached to the drive shaft. Indeed, both housing 12 and rotor 14 can move, as long as rotor 14 rotates with respect to housing 12.

Figure 3:
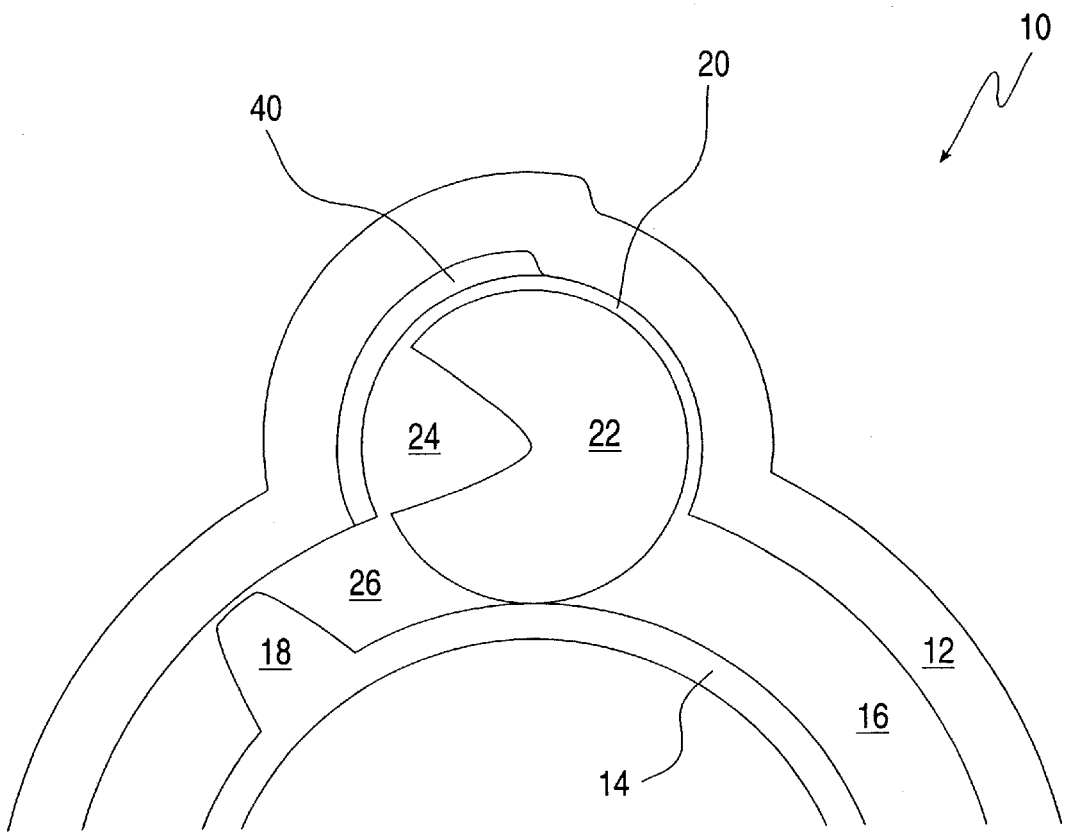
FIG. 3 is a partial transverse cross section of a variant of the engine of FIG. 1.

FIG. 3 is a partial transverse cross-section of a variant of engine 10 in which housing recess 20 includes a channel 40 that connects to compression region 26. The purpose of channel 40 is to equalize pressure between compression region 26 and valve recess 24, so that the pressure of the compressed air-fuel mixture in compression region 26 does not drop suddenly when valve 22 reaches the point in the rotation of valve 22 at which valve recess 24 opens upon compression region 26.

Figure 4:
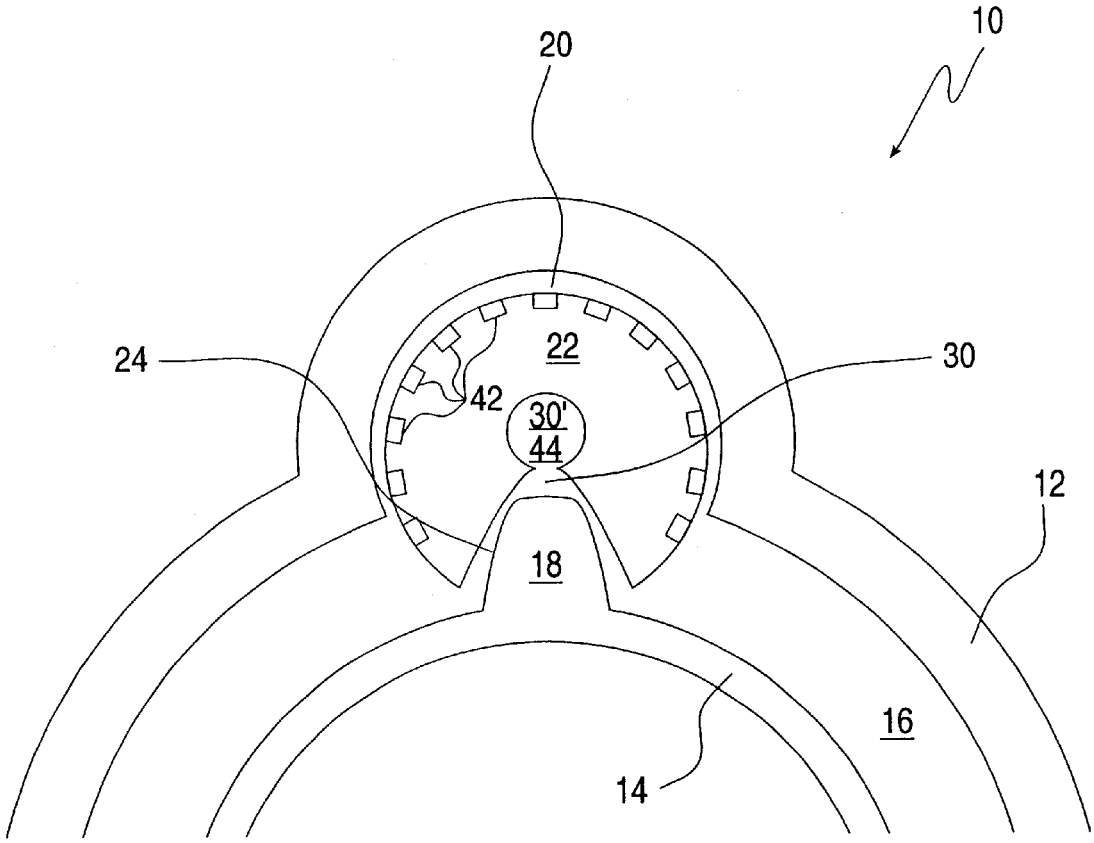
FIG. 4 is a partial transverse cross section of another variant of the engine of FIG. 1.

FIG. 4 is a partial transverse cross-section of a variant of engine 10 in which valve recess 24 leads to a cylindrical chamber 44 in the center of valve 22. With piston 18 occupying valve recess 24 as shown, both cylindrical chamber 44 and the portion of valve recess 24 not occupied by piston 18 combine to form a combustion region 30' that is enlarged with respect to combustion region 30 of FIG. 2B and that also has a more nearly constant volume, as piston 18 passes valve 22, than combustion region 30 of FIG. 2B. FIG. 4 also shows the periphery of valve 22 partly occupied by graphite blocks 42. Graphite blocks 42 lubricate the movement of the periphery of valve 22 past the inner surface of housing 12, where valve 22 and housing 12 are in sliding contact. This and other lubrication systems are discussed in more detail below.

Figure 5A:
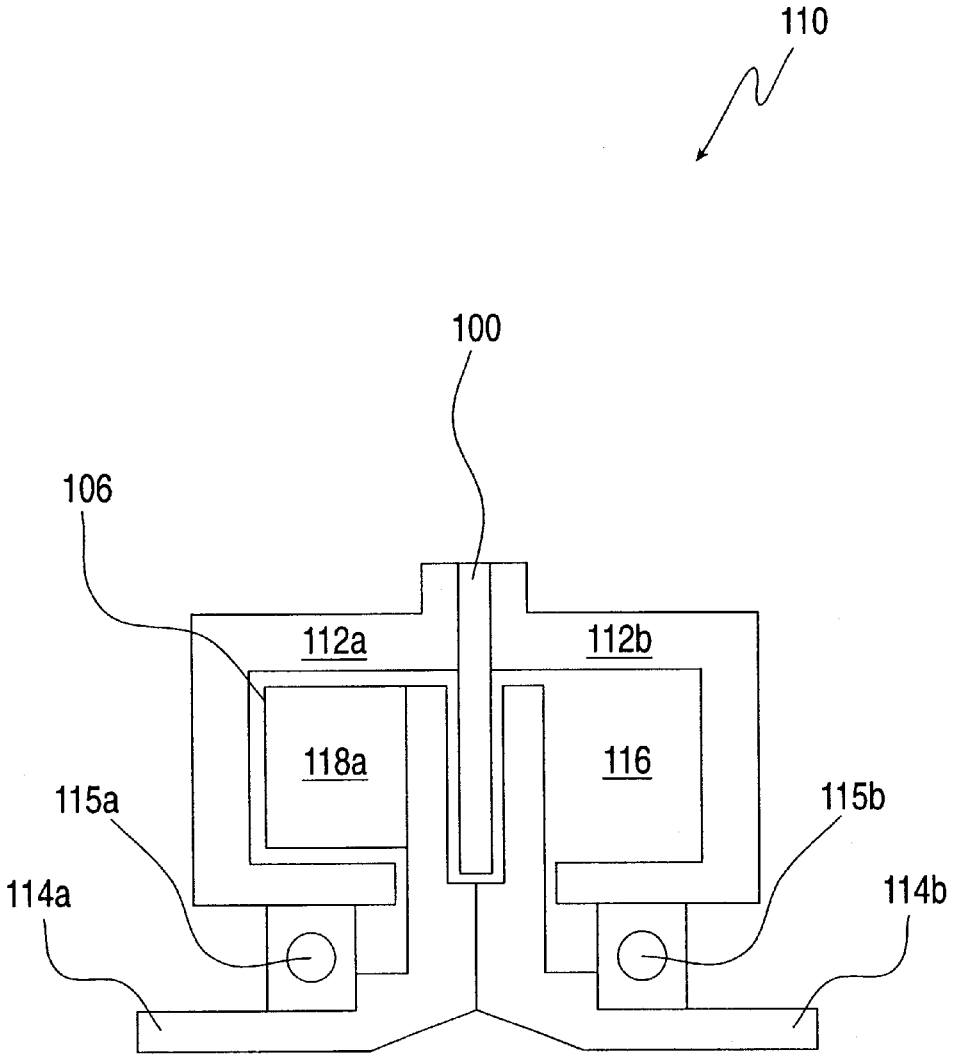
FIG. 5A is a partial axial cross-section of a second embodiment of an engine of the present invention.
Figure 5B:
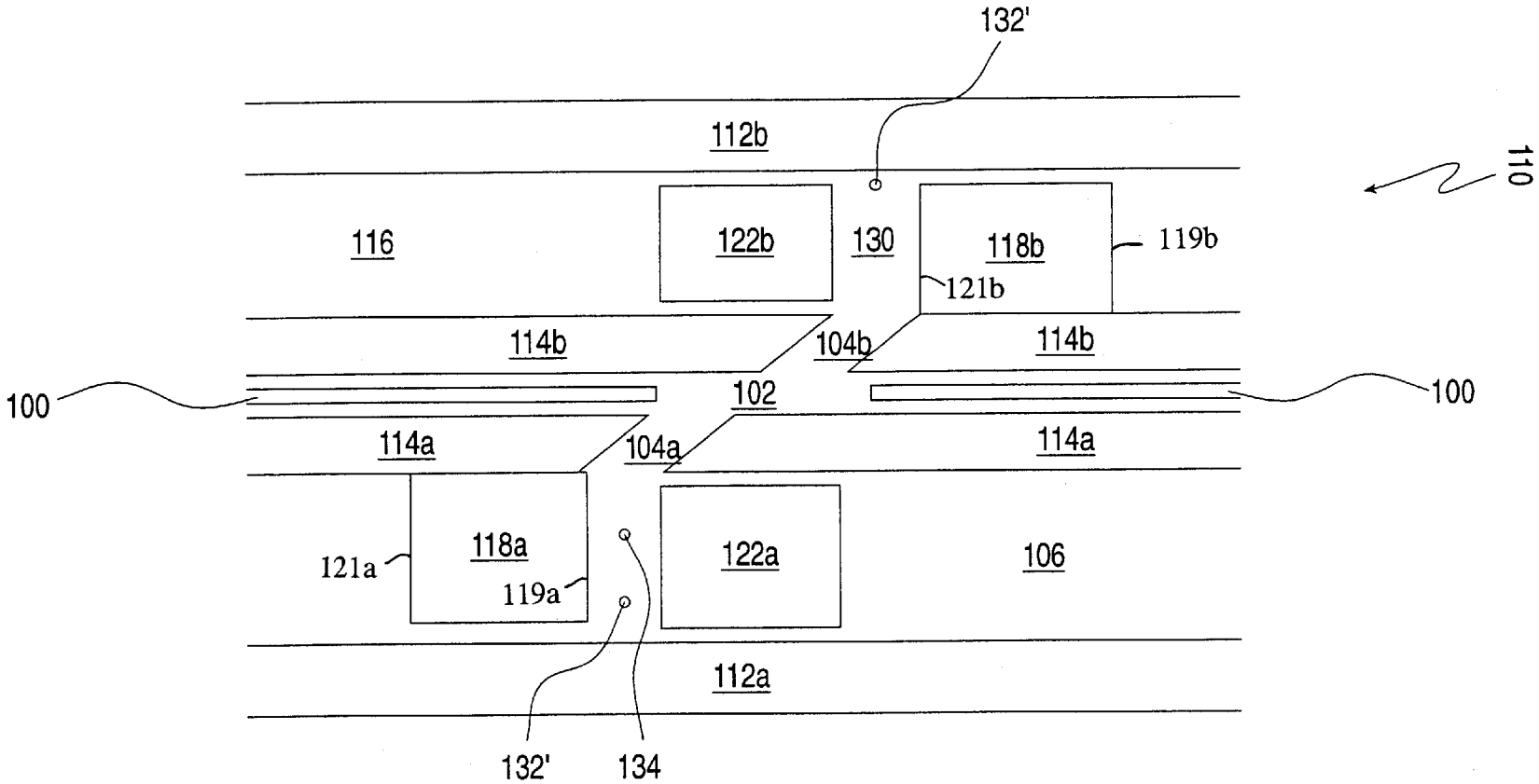
FIG. 5B is a partial cut-away top view of the engine of FIG. 5A.

FIG. 5A is a partial axial cross-section of a second embodiment 110 of an engine of the present invention. FIG. 5B is a partial cut-away top view of embodiment 110. In embodiment 110, a first stationary housing 112*a* and a second stationary housing 112*b* sandwich between them an annular partition 100. A first rotor 114*a*, supported within housing 112*a* by bearings 115*a*, rotates within housing 112*a* and defines, along with housing 112*a*, a toroidal compression chamber 106. A second rotor 114*b*, supported within housing 112*b* by bearings 115*b*, rotates within housing 112*b* and defines, along with housing 112*b*, a toroidal expansion chamber 116. Rotors 114*a* and 114*b* are rigidly joined to each other and rotate together with respect to housings 112*a* and 112*b*. A piston 118*a* projects from rotor 114*a* into compression chamber 106. A piston 118*b* projects from rotor 114*b* into expansion chamber 116. The motion of rotors 114*a* and 114*b* relative to housings 112*a* and 112*b* is from left to right in FIG. 5B, so that faces 119*a* and 119*b* of pistons 118*a* and 118*b* are leading faces and faces 121*a* and 121*b* of pistons 118*a* and 118*b* are trailing faces, and so that piston 118*a* lags piston 118*b*. Because pistons 118*a* and 118*b* are never opposite each other across partition 100, only piston 118*a* is shown in FIG. 5A. As in embodiment 10, a disk-shaped valve 122*a* rotates, within a housing recess in housing 112*a*, in a direction opposite to the rotation of rotor 114*a*. Valve 122*a* includes a valve recess that accommodates piston 118*a* as piston 118*a* passes valve 122*a*. Similarly, a disk-shaped valve 122*b* rotates, within a housing recess in housing 112*b*, in a direction opposite to the rotation of rotor 114*b*. Valve 122*b* includes a valve recess that accommodates piston 118*b* as piston 118*b* passes valve 122*b*.

Valves 122*a* and 122*b* are on opposite sides of partition 100. Partition 100 includes a port 102 between valves 122*a* and 122*b*. Rotor 114*a* includes a port 104*a* that leads piston 118*a*. Rotor 114*b* includes a port 104*b* that lags piston 114*b*. When both pistons 118*a* and 118*b* are approaching valves 122*a* and 122*b*, piston 118*a* and valve 122*a* define between them a compression region analogous to compression region 26 of FIG. 2A. When both pistons 118*a* and 118*b* are departing from valves 122*a* and 122*b*, piston 118*b* and valve 122*b* define between them an expansion region analogous to expansion region 28 of FIG. 2C. FIG. 5B shows the intermediate situation: piston 118*a* approaching valve 122*a* while piston 118*b* departs from valve 122*b*. Now, both port 104*a* and port 104*b* are adjacent to port 102, forming an open passage between chambers 106 and 116, so that pistons 118*a* and 118*b* and valves 122*a* and 122*b* define among them a combustion region 130 that is bounded on the left by leading face 119*a* and on the right by trailing face 121*b*. When pistons 118*a* and 118*b* are both either approaching valves 122*a* and 122*b* or departing from valves 122*a* and 122*b*, ports 104*a* and 104*b* are adjacent to partition 100, so that chambers 106 and 116 are sealed off from each other unless pistons 118*a* and 118*b* are on opposite sides of valves 122*a* and 122*b*, as shown in FIG. 5B.

The operation of embodiment 110 is similar to the operation of embodiment 10. While both pistons 118*a* and 118*b* approach valves 122*a* and 122*b*, piston 118*a* compresses air against valve 122*a* and fuel is injected into the compressed air via a fuel injection port 132 to form a compressed air-fuel mixture. After piston 118*b* passes valve 122*b*, the air-fuel mixture is ignited by an ignition source 134 and burns in combustion region 130. After piston 118*a* passes valve 122*a* and chamber 116 is cut off from chamber 106, the hot burning gas mixture thus created pushes piston 118*b* away from valve 122*b*. More fuel is injected via a fuel injection port 132' to maintain continued combustion and keep the expanding gas mixture at least initially at approximately constant pressure.

Figure 6B:
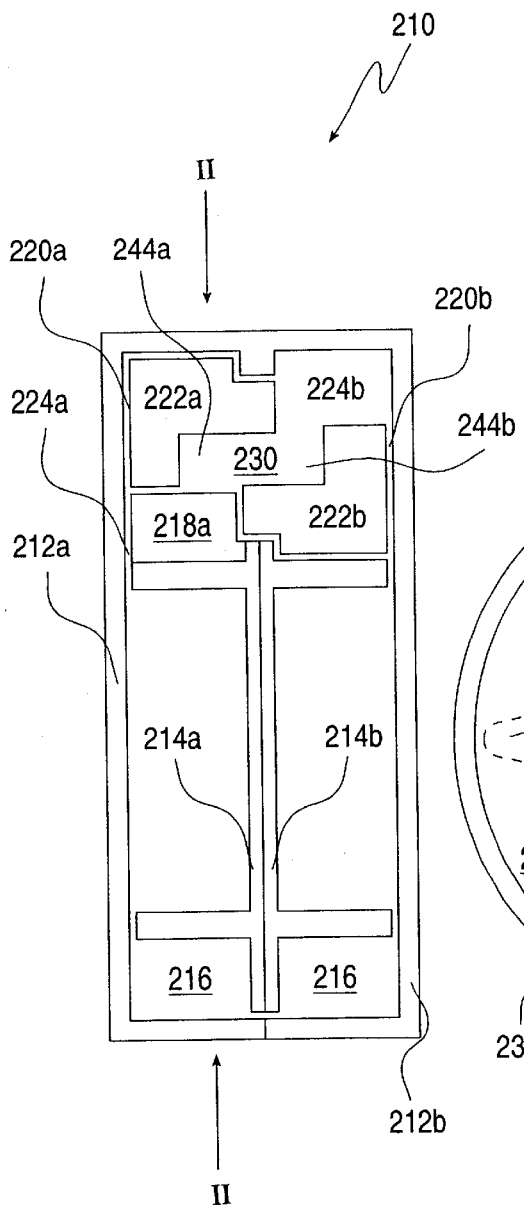
FIGS. 6A and 6B are transverse and axial cross-sections of a third embodiment of an engine of the present invention.
Figure 6A:
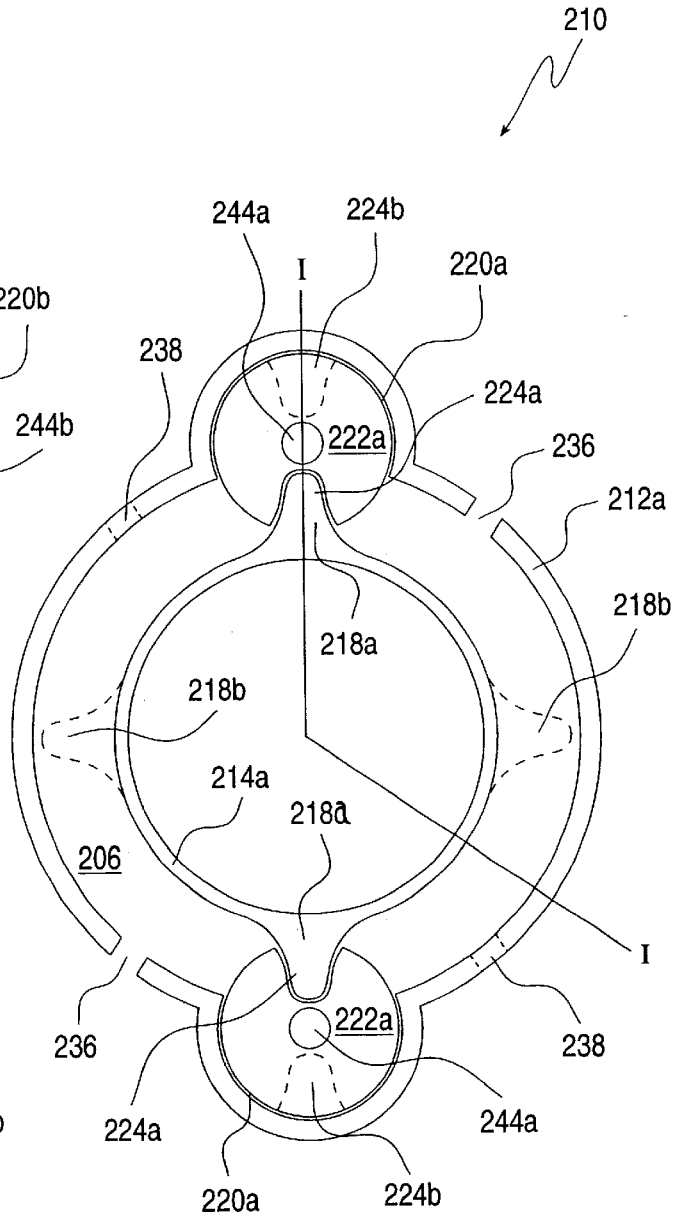

FIG. 6A is a transverse cross-section of a third embodiment 210 of an engine of the present invention. FIG. 6B is an axial cross-section of embodiment 210, taken along cut I—I of FIG. 6A. The transverse cross-section of FIG. 6A is taken along cut II—II of FIG. 6B. As in embodiment 110, a first stationary housing 212*a* is mated to a second stationary housing 212*b*. A first rotor 214*a* rotates within housing 212*a* and defines, along with housing 212*a*, a toroidal compression chamber 206. A second rotor 214*b* rotates within housing 212*b* and defines, along with housing 212*b*, a toroidal expansion chamber 216. As in embodiment 110, rotors 214*a* and 214*b* are rigidly joined to each other and rotate together with respect to housings 212*a* and 212*b*. Two pistons 218*a* project from rotor 214*a* into compression chamber 206. Two pistons 218*b*, shown in phantom in FIG. 6A, project from rotor 214*b* into expansion chamber 216. The motion of rotors 214*a* and 214*b* relative to housings 212*a* and 212*b* is clockwise in FIG. 6A, so that pistons 218*a* lead corresponding pistons 218*b* by 90°. As in embodiments 10 and 110, disk-shaped valves 222*a* and 222*b* rotate within housing recesses 220*a* in housing 212*a* and housing recesses 220*b* in housing 220*b*, respectively, in a direction opposite to the rotation of rotors 214*a* and 214*b*, i.e., counterclockwise in FIG. 6A. Valves 222*a* include valve recesses 224*a* that accommodate pistons 218*a* as pistons 218*a* pass valves 222*a*. Similarly, valves 222*b* include valve recesses 224*b*, shown in phantom in FIG. 6A, that accommodate pistons 218*b* as pistons 218*b* pass valves 222*b*. Because valves 222*a* and 222*b* rotate twice for each rotation of rotors 214*a* and 214*b*, valve recesses 224*b* are displaced by 180° from the corresponding valve recesses 224*a*. Each valve 222*a* and 222*b* includes a central cylindrical chamber 244*a* and 244*b*, respectively, that are in communication with respective valve recesses 224*a* and 224*b*. Cylindrical chambers 244*a* and 244*b* of opposed valves 222*a* and 222*b* also are open to each other, as shown in FIG. 6B, thereby forming a combustion region 230.

The operation of engine 210 is similar to the operation of engines 10 and 110. As pistons 218*a* sweep through compression chamber 206 towards valves 222*a*, pistons 218*a* compress air ahead of themselves, in compression regions defined by pistons 218*a* and valves 222*a* towards which pistons 218*a* approach, while also drawing in more air behind themselves into compression chamber 206 via air inlet ports 236. As pistons 218*a* approach valves 222*a*, fuel is injected into the compressed air via fuel injection ports (not shown) to produce compressed fuel-air mixtures. As pistons 218*a* enter valve recesses 224*a*, these compressed fuel-air mixtures are pushed into combustion regions 230 and, if necessary, are ignited by appropriate ignition sources (not shown). After pistons 218*a* leave valves 222*a*, and while pistons 218*b* are approaching valves 222*b*, the fuel-air mixture burns in combustion regions 230 under constant-volume conditions. As pistons 218*b* depart from valves 222*b*, the hot high-pressure gases created by the combustion process leave combustion regions 230 into expansion chamber 216, specifically, into expansion regions defined by pistons 218*b* and valves 222*b*, and push pistons 218*b* away from valves 222*b*. Further injection of fuel into the expansion regions, and the ensuing continued combustion, keep the expanding gases at least initially at approximately constant pressure. As pistons 218*b* sweep through expansion chamber 216, pistons 218*b* push residual gases from previous cycles out through exhaust ports 238, of housing 212*b*, that are shown in phantom in FIG. 6A.

To understand the fourth embodiment of the engine of the present invention, it is useful first to consider the prior art engine described by Edwards in International Publication WO 93/21423, which is incorporated by reference for all purposes as if fully set forth herein. This prior art engine is partly illustrated in transverse cross section in FIG. 7, which shows a transverse cross section through a cylindrical housing 312 wherein rotates a rotor 314 that is rigidly attached to a coaxial drive shaft 356. Rotor 314 rotates in a clockwise direction. Lobe seals 302 of rotor 314 contact inner surface 306 of housing 312. Side face seals 304 of rotor 314 contact the inner surfaces of two side plates (not shown). Two groups 308 of ports and valve assemblies 321 are on opposite sides of housing 312. Each valve assembly 321 includes a blade valve 322 that slides radially in a blade valve housing 320 and is urged against outer surface 340 of rotor 314 by an appropriate mechanism such as a spring 342. Air enters an induction region 348 via an inlet port 336 and is compressed between rotor 314 and the upper blade valve 322 in a compression region 350. This compressed air is conducted to a separate combustion chamber (not shown) via a compression port 344, where fuel is injected into the compressed air and burned. The hot gas mixture thus formed is introduced to an expansion region 352 via a power port 346, to push on rotor 314. Spent gases from the previous cycle are ejected from an exhaust region 354 by rotor 314 via an exhaust port 338. The activity in housing 314 is synchronized with the activity in the combustion chamber by means of a mechanism including a timing gear 358.

Figure 7:
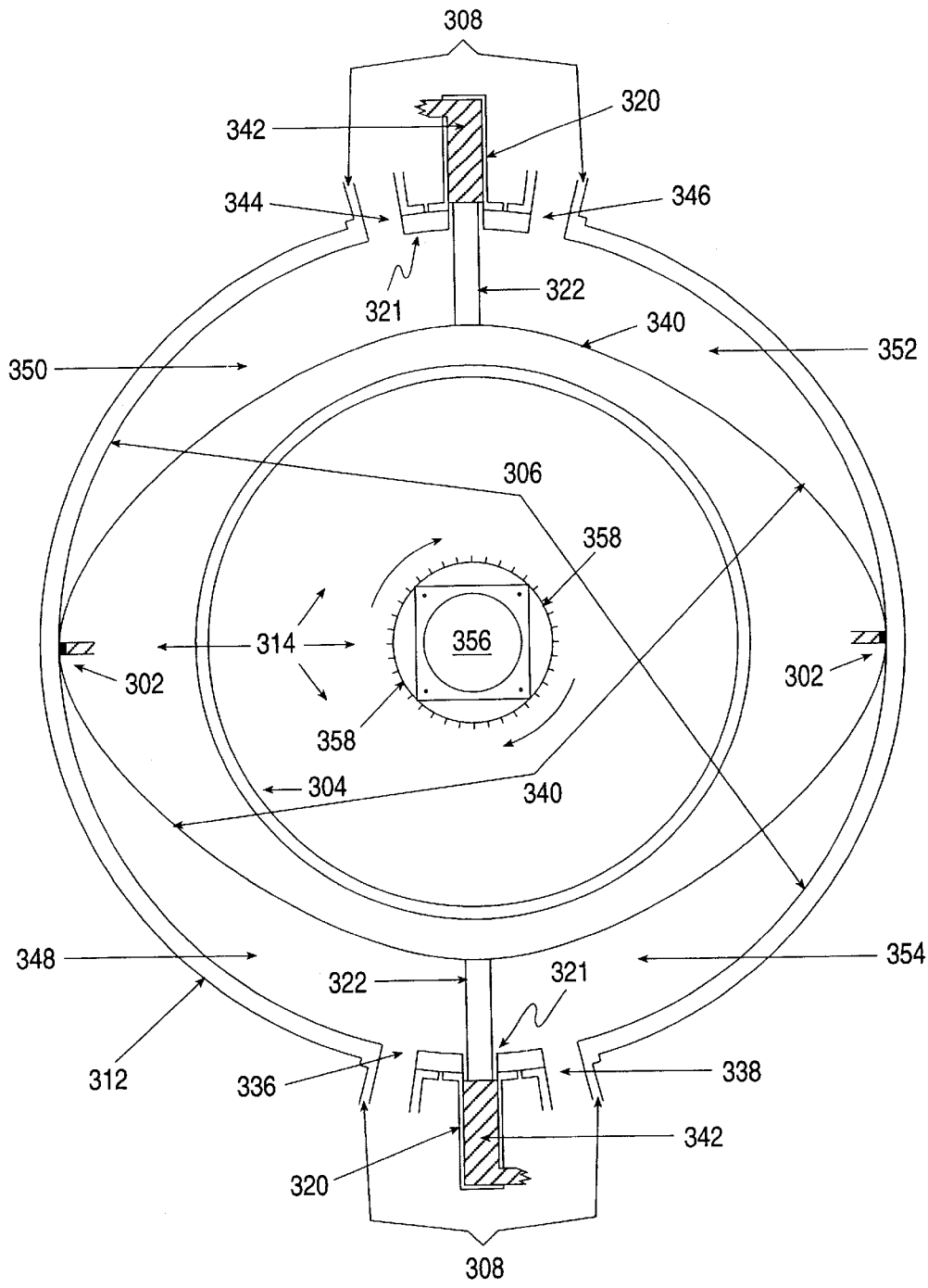
FIG.7 (PRIOR ART)
FIG. 7 is a transverse cross-section of a prior art engine.
Figure 8:
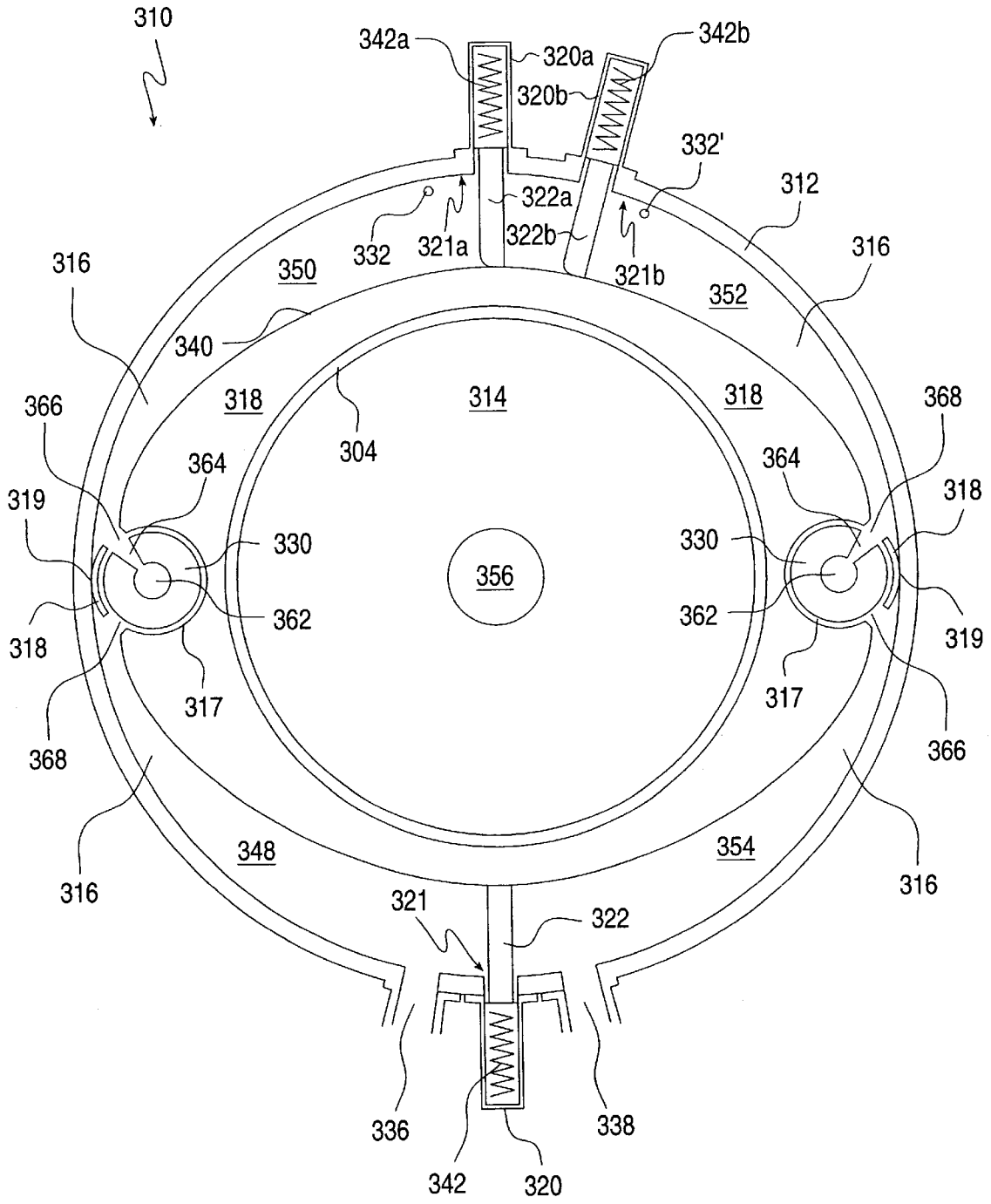
FIG. 8 is a transverse cross-section of a first variant of a fourth embodiment of an engine of the present invention.

FIG. 8 is a transverse cross-section of a first variant 310 of a fourth embodiment of an engine of the present invention. Engine 310 is modified from the prior art engine of FIG. 7, so like reference numerals in the two Figures refer to like parts. As understood herein, the portion of rotor 314 that is radially beyond side face seals 304 is considered to be a pair of pistons 318. Housing 312, and the portion of rotor 314 that is radially at side face seals 304, define between them a toroidal chamber 316. Apices 319 of pistons 318 are in sliding contact with the inner wall of housing 312. Near each apex 319, a piston recess 317 in each piston 318 includes enclosed therein a disk-shaped combustion chamber 330 that rotates within piston 318 as described below. Each combustion chamber 330 defines a combustion region 362 and an inlet/outlet port 364. Piston inlet ports 366 and piston outlet ports 368 allow communication between toroidal chamber 316 and combustion chambers 362 via inlet/outlet ports 364, as described below.

The essential difference between engine 310 and the prior art engine of FIG. 7 is that in engine 310, the combustion takes place inside pistons 318 and expansion region 352 rather than in an external combustion chamber. Consequently, engine 310 lacks compression port 344 and power port 346. Instead, engine 310 has two valve assemblies, a compression valve assembly 321*a* and an expansion valve assembly 321*b*, on the side of housing 312 opposite ports 336 and 338. Compression region 350 is to the left of these two valve assemblies, and expansion region 352 is to their right.

Figure 9B:
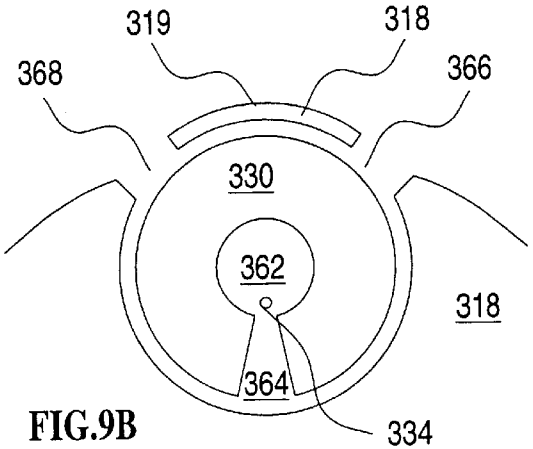
FIGS. 9A, 9B and 9C show three positions of a combustion chamber of the engine of FIG. 8.
Figure 9C:
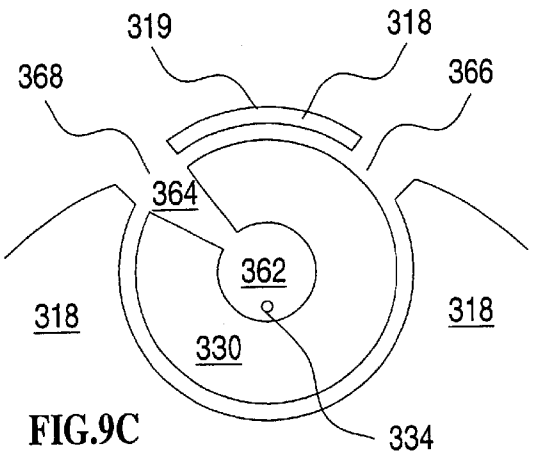
Figure 9A:
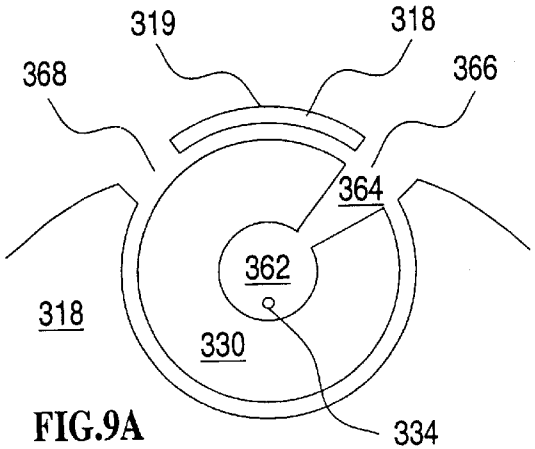

FIG. 9A shows the position of combustion chamber 330 relative to its respective piston 318 while piston inlet 366 faces compression region 350. Combustion chamber 330 is turned so that inlet/outlet 364 faces piston inlet 366 to admit the air compressed in compression region 350 to combustion region 362. As apex 319 approaches blade valve 322*a* of compression valve assembly 321*a*, fuel is injected into the compressed air via a fuel injection port 332. As apex 319 passes blade valve 322*a*, combustion chamber 330 turns to the position shown in FIG. 9B. An ignition source 334 in piston 318 adjacent to combustion region 362 ignites the compressed fuel-air mixture in combustion region 362 and inlet/outlet port 364. The fuel-air mixture continues to burn while apex 319 transits from the blade valve 322*a* to blade valve 322*b* of expansion valve assembly 321*b*. In fact, the reason why two valve assemblies are provided opposite ports 336 and 338 is to allow time for the initial combustion to proceed at substantially constant volume. After apex 319 passes blade valve 322*b*, compression chamber 330 turns to the position shown in FIG. 9C, with inlet/outlet 364 facing piston outlet 368. The hot, high-pressure combustion gases inside compression chamber 330 enter expansion region 352 and push piston 318 and rotor 314 in a clockwise direction. More fuel is injected via a fuel injection port 332' in expansion region 352, to continue the combustion and maintain the hot expanding gases at least initially at approximately constant pressure.

Figure 10A:
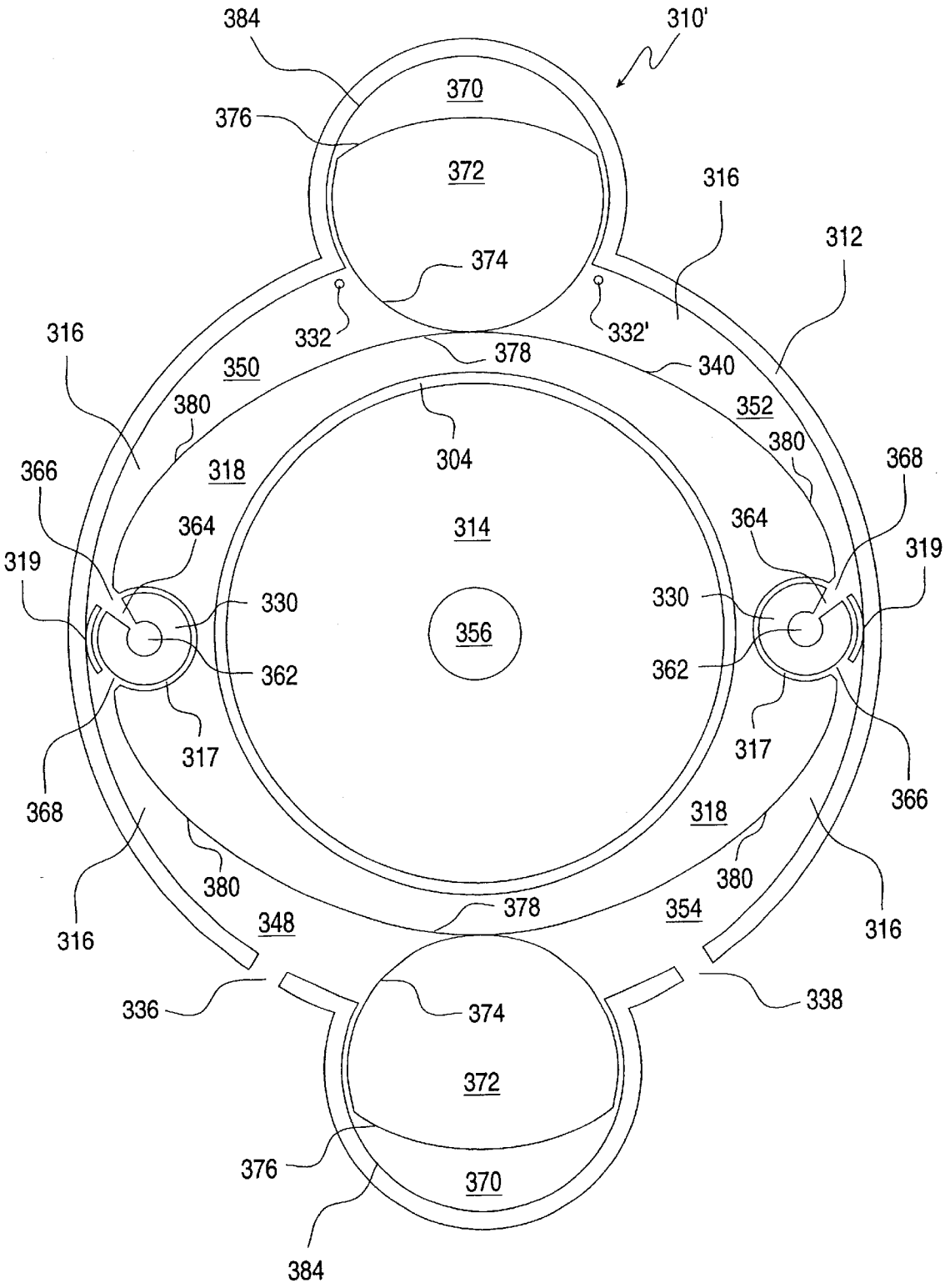
FIGS. 10A and 10B are transverse cross-sections of a modification of the engine of FIG. 8.
Figure 10B:
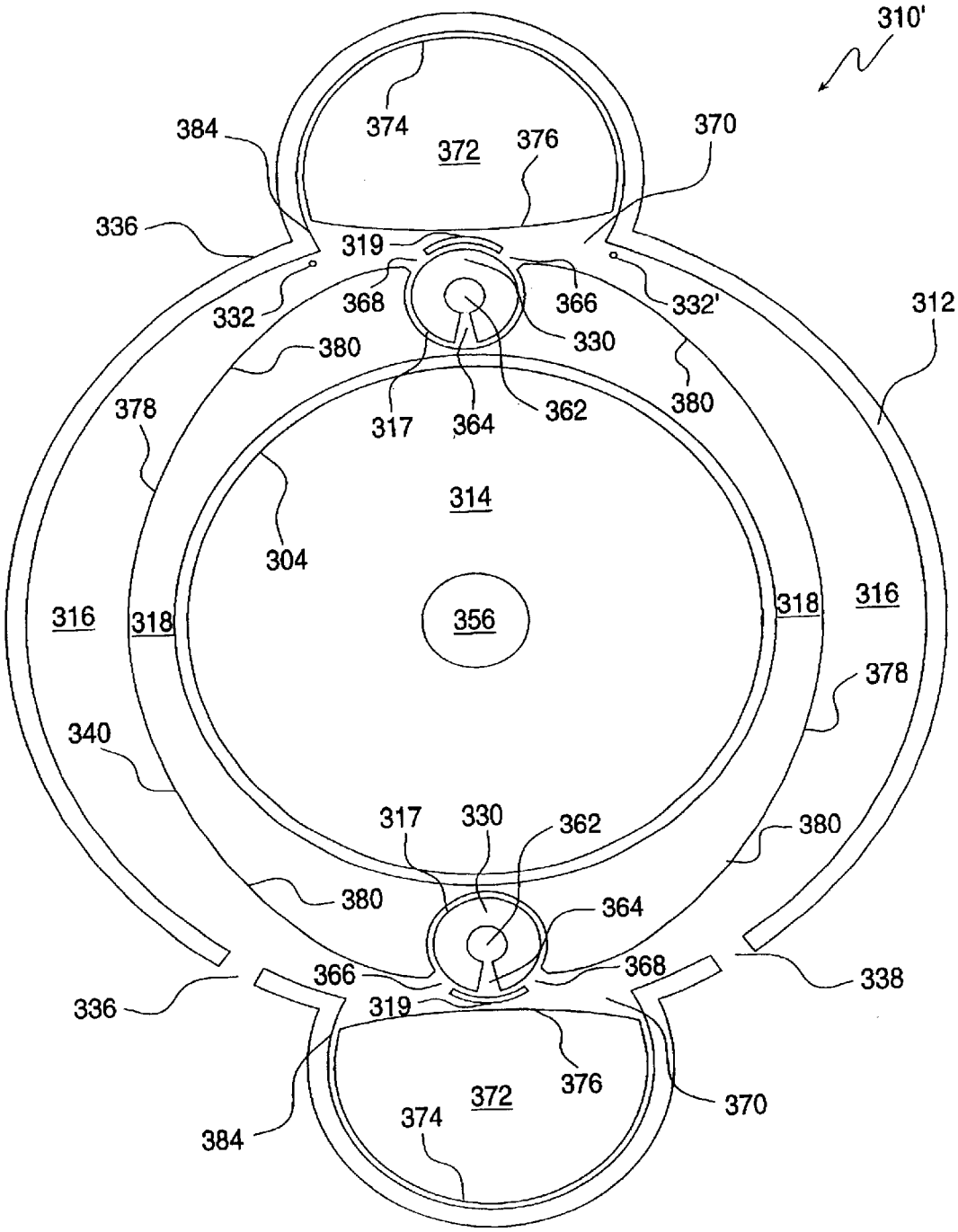

FIGS. 10A and 10B are transverse cross sections of a modified version 310' of variant 310. The difference between engines 310 and 310' is that instead of valves 322, 322*a* and 322*b* and valve housings 320, 320*a* and 320*b*, engine 310' has valves 372 that rotate within housing recesses 370, just as valves 22 and 22' rotate within housing recesses 20 and 20' of embodiment 10. Unlike valves 22 and 22', however, valves 372 are not circular disks. Instead, valves 372 are shaped to maintain rolling contact with outer surface 340 of rotor 314. Specifically, the axial profiles of each valve 372 includes a first arcuate portion 374 and a second arcuate portion 376. Arcuate portion 374 is shaped to maintain rolling contact with outer surface 340 along portions 378 thereof whose radial distances from the rotational axis of rotor 314 are constant, and arcuate portion 376 is shaped to maintain rolling contact with outer surface 340 along portions 380 thereof whose radial distance increases monotonically (preferably linearly) between portions 378 and apices 319, and also along apices 319. FIG. 10A shows arcuate portions 374 in contact with portions 378. FIG. 10B shows arcuate portions 376 in contact with apices 319.

Figure 11:
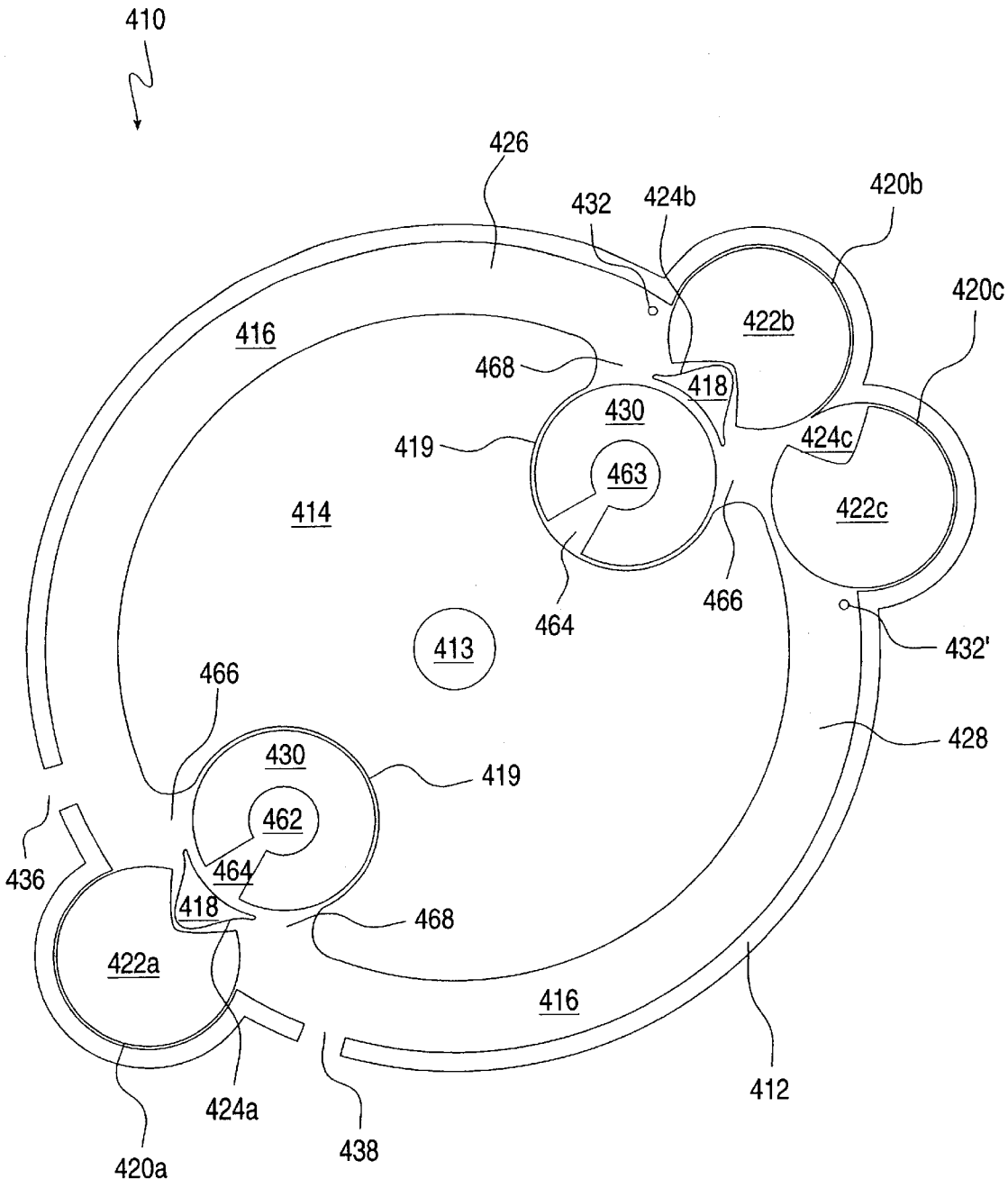
FIG. 11 is a transverse cross-section of a second variant of the fourth embodiment of an engine of the present invention.

FIG. 11 is a transverse cross-section of a second variant 410 of the fourth embodiment of the engine of the present invention. Within a housing 412 rotates a rotor 414 that is rigidly attached to a central drive shaft 413 that is coaxial with housing 412 and with rotor 414. Housing 412 and rotor 414 define between them a toroidal chamber 416. Two pistons 418 project from rotor 414 into chamber 416. On one side of housing 412 is a housing recess 420*a* that accommodates a disk-shaped valve 422*a* that rotates within housing recess 420*a*. On one side of housing recess 420*a* is an air inlet port 436. On the other side of housing recess 420*a* is an exhaust port 438. On the other side of housing 412 are two housing recesses 420*b* and 420*c*, each of which accommodates a disk-shaped valve 422*b*, 422*c* that rotates within its respective housing recess 420*b*, 420*c*. Like valves 22 and 22', valves 422*a*, 422*b* and 422*c* rotate within their respective housing recesses in directions opposite to the direction of rotation of rotor 414. Each valve 422*a*, 422*b* and 422*c* includes a valve recess 424*a*, 424*b* and 424*c*, respectively. The outer diameter of rotor 414 is twice the diameters of valves 422*a*, 422*b* and 422*c*. Valves 422*a*, 422*b* and 422*c* rotate twice for each rotation of rotor 414, so that the surfaces of valves 422*a*, 422*b* and 422*c* and of rotor 414 that are in mutual contact do not slide relative to each other. Valve recesses 424*a*, 424*b* and 424*c* accommodate pistons 418 as pistons 418 move past valves 422*a*, 422*b* and 422*c*. Valves 422*a*, 422*b* and 422*c* serve the same purposes as valves 322, 322*a* and 322*b* of engine 310, respectively. In particular, valve 422*b* and piston 418 define a compression region 426 in chamber 416 as piston 418 approaches valve 422*b*, and valve 422*c* and piston 418 define an expansion region 428 in chamber 416 as piston 418 departs from valve 422*c*.

Rotor 414 includes and encloses, adjacent to each piston 418, a disk-shaped combustion chamber 430 that rotates within a rotor recess 419. Each combustion chamber 430 includes a combustion region 462 and an inlet/outlet port 464. Each rotor recess includes a rotor inlet port 466 and a rotor outlet port 468 that open into chamber 416.

Engine 410 operates in the same manner as engine 310. As piston 418 approaches valve 422*b*, air that entered chamber 416 via air inlet port 436 is compressed in compression region 426. Compression chamber 430 turns so that inlet/outlet port 464 faces rotor inlet port 466 to admit compressed air from compression region 426 into combustion chamber 462. When piston 418 has almost reached valve 422*b*, fuel is injected into compression region 462 via a fuel injection port 432. As piston 418 passes valve 422*b*, combustion chamber 430 rotates so that inlet/outlet port 462 faces away from piston 418, as shown in FIG. 10, and an ignition source (not shown) ignites the compressed fuel-air mixture. After piston 418 has passed valve 422*c*, combustion chamber 430 rotates so that inlet/outlet port 464 faces rotor outlet port 468, allowing the hot, high-pressure gases in combustion region 462 to emerge into expansion region 428 and push piston 418 and rotor 414 clockwise, as piston 418 expels spent gases from the previous cycle out of chamber 416 via exhaust port 438. More fuel is injected via a fuel injection port 432 in expansion region 428 to continue combustion and maintain the expanding gases at least initially at approximately constant pressure. The rotations of rotor 414, valves 420*a* 420*b* and 420*c*, and combustion chambers 430 are synchronized by conventional mechanical linkages (not shown).

Figure 12A:
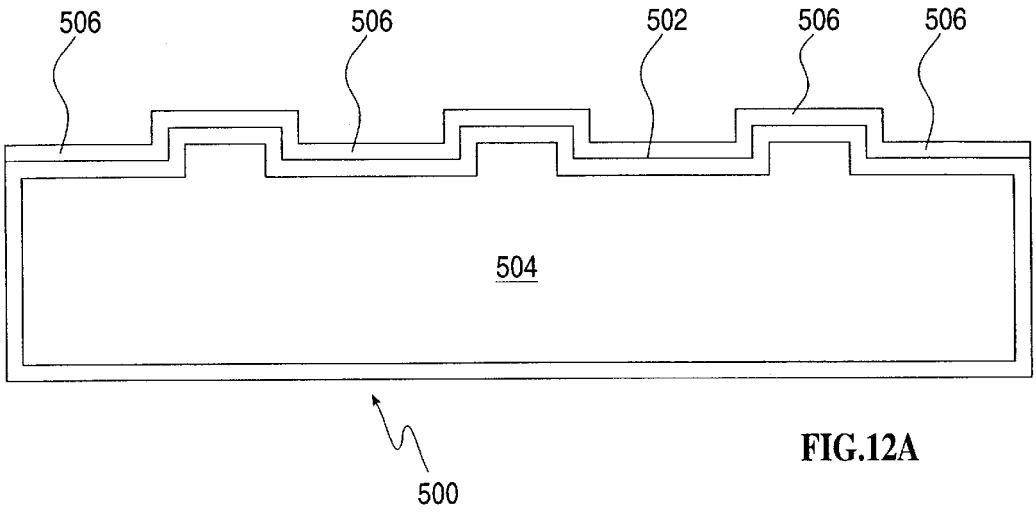
FIGS. 12A and 12B show two mechanisms for cooling and lubricating surfaces that are in sliding contact.
Figure 12B:
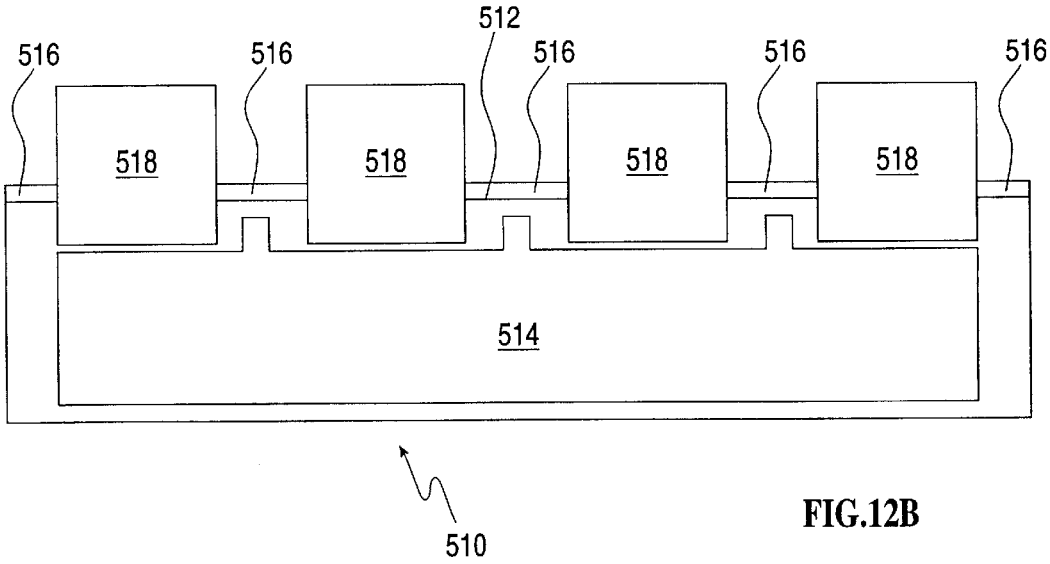

FIGS. 12A and 12B are generalized illustrations of the mechanisms used in the present invention for thermal stabilization and for lubricating surfaces that are in sliding contact with each other. The mechanism illustrated in FIG. 12A is substantially the same as the one taught in U.S. Pat. No. 5,797,366. FIG. 12A is a cross-section of a body 500, such as valve 22 of FIG. 4 or piston 318 of FIG. 8, the surface of one side 502 whereof is in sliding contact with a surface of another body. Body 500 is made of a heat-resistant material of high thermal conductivity, such as heat-resistant steel or titanium, and encloses a channel 504 for cooling water. Side 502 is covered with an outer lining 506 of a heat -resistant, low-thermal-conductivity material such a ceramic or a zirconium alloy. Side 502 is in the form of a labyrinth seal, as taught in U.S. Pat. No. 5,797,366.

FIG. 12B is a cross section of a body 510, the surface of one side 512 whereof is in sliding contact with the surface of another body. Body 510 is made of a heat-resistant material of high thermal conductivity, such as heat-resistant steel or titanium, and encloses a channel 514 for a cooling fluid. Side 512 is covered with an outer lining 516 similar to lining 506. Side 512 is fitted with blocks 518 of a heat-resistant material with a low coefficient of friction, for example, graphite or ceramic. Valve 22 of FIG. 4, which bears graphite blocks 42, is a specific instance of body 510.

While the invention has been described with respect to a limited number of embodiments, it will be appreciated that many variations, modifications and other applications of the invention may be made.

What is claimed is:

1. An engine, comprising:

(a) two axially adjacent housings;

(b) for each of said housings: a rotor, rotatably mounted within said each housing, said rotor and said each housing defining between them a toroidal chamber, said rotor including a piston projecting into said toroidal chamber, said piston including a leading face and a trailing face, said rotors of said two housings being joined so that said rotors rotate together within said two housings; and (c) for each said housing, at least one valve, movably mounted within said at least one housing, one of said at least one valve of a first of said two housings being axially adjacent one of said at least one valve of a second of said two housings, a combustion region of substantially constant volume being bounded by said leading face of said piston of a first of said two housings and by said trailing face of said piston of a second of said two ho usings as said piston of said first housing approaches said one of said at least one valve of said first housing and said piston of said second housing departs said one of said at least one valve of said second housing; and (d) an annular partition between said two housings, said annular partition including a port between said two axially adjacent valves;

and wherein said rotor of said first housing and said rotor of said second housing each include a port between said piston of said first housing and said piston of said second housing, so that, as said piston of said first housing approaches said two axially adjacent valves and said piston of said second housing departs from said two axially adjacent valves, said ports of said rotors are adjacent said port of said annular partition, thereby combining a first region, in said toroidal chamber of said first housing, between said piston of said first housing and said two axially adjacent valves, and a second region, in said toroidal chamber of said second housing, between said piston of said second housing and said two axially adjacent valves, thereby forming said combustion region.

2. The engine of claim 1, wherein each said housing includes at least one said piston and wherein each said housing includes at least as many of said at least one valve as said at least one piston.

3. The engine of claim 2, wherein each said housing includes equal numbers of said at least one valve and said at least one piston.

4. The engine of claim 1, wherein, in each said housing, said at least one valve includes a circular disk having a recess shaped to accommodate said piston as said piston moves past said at least one valve.

5. The engine of claim 4, wherein, in one of said housings, one of said at least one valve cooperates with said one of said housings, with said rotor of said one of said housings, and with said piston of said rotor of said one of said housings to form a compression region as said piston approaches said one of said at least one valve.

6. The engine of claim 4, wherein, in one of said housings, one of said at least one valve cooperates with said one of said housings, with said rotor of said one of said housings, and with said piston of said rotor of said one of said housings to form an expansion region as said piston departs from said one of said at least one valve.

7. The engine of claim 1, wherein, in a first of said housings, one of said at least one valve cooperates with said first housing, with said rotor of said first housing, and with said piston of said rotor of said first housing to form a compression region as said piston approaches said one of said at least one valve, the engine further comprising:

(d) a mechanism for injecting fuel into said compression region.

8. The engine of claim 7, wherein, in a second of said housings, one of said at least one valve cooperates with said second housing, with said rotor of said second housing, and with said piston of said rotor of said second housing to form an expansion region as said piston departs from said one of said at least one valve, the engine further comprising:

(e) a mechanism for injecting fuel into said expansion region.

* * * * *